United States Patent [19]

Beale

[11] Patent Number: 4,658,858

[45] Date of Patent: Apr. 21, 1987

[54] ELECTROMECHANICAL OXYGEN REGULATOR VALVE ASSEMBLY

[75] Inventor: Robert B. Beale, Arden Hills, Minn.

[73] Assignee: The United States of America as represented by the Secretary of the Air Force, Washington, D.C.

[21] Appl. No.: 791,955

[22] Filed: Oct. 28, 1985

[51] Int. Cl.[4] ..... F17D 3/01

[52] U.S. Cl. ..... 137/606; 251/129.21

[58] Field of Search ..... 137/78.5, 554, 602, 137/606; 251/129.18, 129.21; 128/204.19, 205.24

[56] References Cited

U.S. PATENT DOCUMENTS

| | | | |
|---|---|---|---|
| Re. 27,699 | 7/1973 | Weaver et al. | 251/129.21 |
| 3,039,481 | 6/1962 | Schreiber et l. | 137/64 |
| 3,610,237 | 10/1971 | Barkalow et al. | 128/145.5 |
| 4,216,795 | 8/1980 | Cobb et al. | 137/554 |
| 4,224,940 | 9/1980 | Monnier | 128/205.16 |
| 4,285,339 | 8/1981 | McIntyre | 128/204.23 |
| 4,352,353 | 10/1982 | Bolton et al. | 128/201.24 |
| 4,504,039 | 3/1985 | Akagi | 251/129.21 |

*Primary Examiner*—Stephen F. Husar

*Attorney, Agent, or Firm*—Thomas L. Kundert; Donald J. Singer

[57] ABSTRACT

The present invention relates to a valve assembly for an oxygen regulator. Two valves mounted in a housing supply oxygen and air flows to a manifold in the housing for subsequent delivery to a recipient's mask. The valves operate as electromechanical servoactuators. The nozzle of each valve serves as a magnetic pole for a surrounding voice coil bobbin. The bobbin fits over the nozzle and has a solid center portion adapted to seal the opening. When current is applied to the voice coil, a force is generated in the bobbin causing it to move toward or away from the nozzle. Movement of the bobbin away from the nozzle varies the opening of the valve and allows gas to be admitted into the housing. A linear variable differential transducer connected to the bobbin senses when proper displacement corresponding to valve opening is attained.

6 Claims, 3 Drawing Figures

ELECTROMECHANICAL OXYGEN REGULATOR VALVE ASSEMBLY

RIGHTS OF THE GOVERNMENT

The invention described herein may be manufactured and used by or for the Government of the United States for all governmental purposes without the payment of any royalty.

CROSS REFERENCE TO RELATED APPLICATIONS

This application is related to my copending U.S. patent application Ser. No. 791,959 for an Electronically Compensated Pressure Dilution Demand Regulator filed on Oct. 28, 1985. The specification and claims of that patent are hereby incorporated by reference herein.

BACKGROUND OF THE INVENTION

1. Field of the Invention

Advanced high performance aircraft require an oxygen delivery system to supply breathing gas to aircraft crew members that is neither too high in oxygen content as to result in hyperoxia or too low so as to prevent hypoxia resulting in crew member fatigue or hyperventilation. Currently designed pneumatic regulators are not sufficiently accurate or responsive to changed conditions in the cabin causing excessive oxygen in the breathing mixture under some conditions and insufficient oxygen under others.

The present invention is a valve assembly for a dilution control oxygen regulator that responds to a command signal from a linear variable differential transducer that senses valve position and whose signal commands the valve to stop when valve position, corresponding to a desired oxygen-air concentration for the recipient's physiological needs, is attained.

2. Description of the Prior Art

Various patents have covered breathing supplies that are regulated by valves.

In U.S. Pat. No. 4,285,339 by McIntyre a demand servomechanism is used to regulate the supply of breathing gas supplied to a user. In McIntyre, the electrical signal is digitally processed and gas control valves are actuated by a "fast loop" electrical system. U.S. Pat. No. 4,352,352, Bolton et al discloses a respirator adapted to protecting the wearer against undesirable substances. U.S. Pat. No. 4,224,940 by Monnier discloses a respirator apparatus with a bellows that receives breathable gas from a suitable gas generator. U.S. Pat. No. 3,039,481 by Schreiber et al, discloses an apparatus with electromagnets for controlling the operating valves of a respirator. U.S. Pat. No. 3,610,237 by Barkalow et al, discloses a throttle valve operated by a spring-biased piston cylinder in a positive pressure breathing apparatus. However, none of the inventions disclose a valve control means with an analog design for controlling breathable gas which also uses a feedback transducer and a balance bellows as in the present invention.

SUMMARY OF THE INVENTION

It is the primary object of the present invention to provide a valve assembly for mixing oxygen and air as part of a means for regulating a supply of breathable gas at varying altitudes.

It is a further object of the present invention to provide a nozzle flapper valve in which the nozzle serves as a magnetic pole piece for a surrounding voice coil bobbin.

It is a further object of this invention to provide an electromagnetic valve assembly having a pressure balance bellows attached to a movable actuating member of the valve to maintain the valve in a normally closed position.

It is still a further object of this invention to provide a valve assembly having a linear variable differential transducer connected to the movable actuating member of the valve for measuring the displacement of the valve opening.

These and other objects are accomplished by the present invention which includes two valves mounted in a housing and connected to air and oxygen supplies that supply oxygen and air flows. Mixing occurs in the housing which serves as a manifold to deliver the mixed gases to a recipient's mask.

The valves operate as electromechanical servoactuators. The nozzle of each valve serves as a magnetic pole for a surrounding voice coil bobbin. The bobbin fits over the nozzle and has a solid center portion adapted to seal the opening. When current is applied to the voice coil, a force is generated in the bobbin causing it to move toward or away from the nozzle. Movement of the bobbin away from the nozzle varies the opening of the valve and allows gas to be admitted into the housing. A feedback transducer connected to the bobbin senses when the proper valve position corresponding to a valve command displacement is reached. The servoloop is an analog design using a linear variable differential transducer to sense valve displacement.

DESCRIPTION OF THE PREFERRED EMBODIMENT

Figure 1:
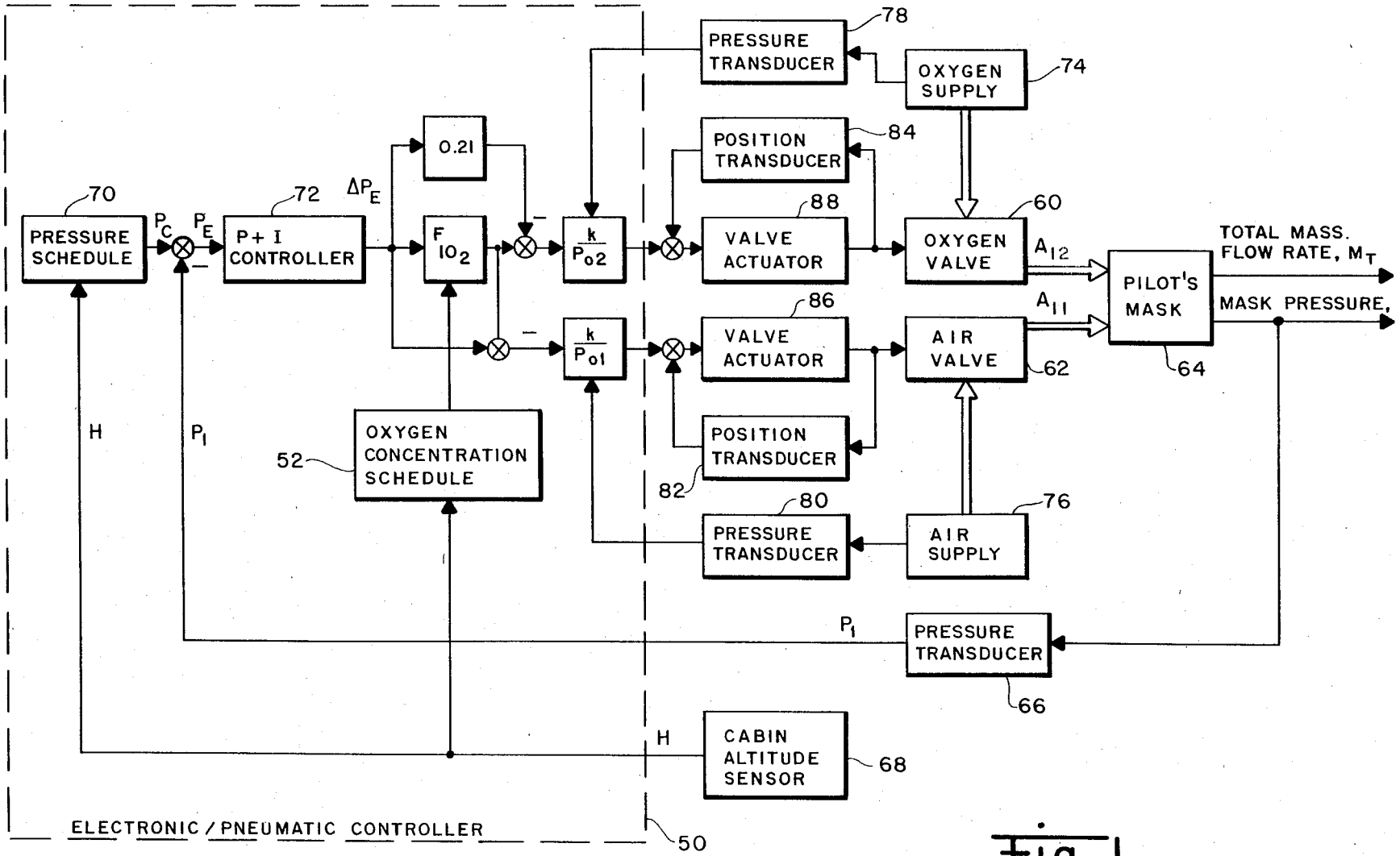
FIG. 1 shows a block diagram of an electrically compensated pressure dilution demand regulator.

FIG. 1 shows in block form a controller 50 for regulating two gas valves, 60, 62, one for oxygen supply 74 and one for air supply 76 which are mounted in a housing 20 (FIG. 2) that serves as a manifold to deliver a breathable gas mixture to a pilot's mask 64. Mask suction pressure, $P_1$, indicating the user's demand for breathing gas is sensed and converted to an electrical signal by pressure transducer 66. Cabin altitude sensor 68 senses the altitude, H, and a signal indicative of altitude is fed to a pressure command schedule 70 to generate a signal $P_C$ indicating a prescribed pressure based on a command rate for a specific altitude. An example of a pressure command schedule is as follows:

```
PC=0.0
IF(H.GE.28000.)PC=1.0
IF(H.GE.38000.)PC=0.00125*(H-38000.)+1.0
IF(H.GE.42000.)PC=0.00172*(H-42000.)+6.0
IF(H.GE.46000.)PC=0.0005*(H-46000)+12.88
IF(H.GE.47000.)PC=0.0022666666*(H-47000.)+13.38
IF(H.GE.50000.)PC=0.001946666*(H-50000.)+20.08
IF(H.GE.56000.)PC=0.0015275*(H-56000.)+31.76
IF(H.GE.60000.)PC=37.87
```

IF(H.GE.38000.)PC=0.001333*(H-38000.)+1.0
IF(H.GE.60000.)PC=30.33 where $P_C$ is in inches of water.
H is altitude in feet.
GE means greater or equal.

It will be understood by those skilled in the art that the pressure command schedule may be modified or tailored for specific applications and that the above pressure command schedule is only illustrative of the invention.

Pressure signal $P_C$ is compared with the demand signal, $P_1$, generated by pressure transducer 66 to produce a pressure error, $P_E$. The pressure error $P_E$ is compensated by a proportional-plus-integral controller 72 to provide rapid response to pressure errors and to eliminate long-term offsets. The resultant pressure error, $\Delta P_E$, is then biased between the two gas valves 60, 62 and serves as a valve command for valve actuators 86, 88.

Pressure error, $\Delta P_E$, from the proportional-plus-integral controller 72, is biased between the two gas valves 60, 62 in proportion to an oxygen concentration schedule 52 which prescribes a desired oxygen concentration percentage based on altitude. For purposes of illustration the oxygen concentration schedule is listed as follows:

FIO2=0.21
IF(H.GE.14000.)FIO2=((0.5-FIO2)/3000.)*(H-14000.)+FIO2
IF(H.GE.17000.)FIO2=0.000045455*(H-17000.)+0.5
IF(H.GE.28000.)FIO2=1.0 where $F_{IO2}$ is the fractional concentration of oxygen in the total gas stream and ranges from 21-100% (0.21-1.9).
H is altitude in feet.
GE means greater or equal.

The valve command bias is derived as shown in the following analysis. The concentration of oxygen is the ratio of the mass flow of each gas. Since air is 21% oxygen, the fractional concentration of oxygen, $F_{IO2}$, may be expressed as $$F_{IO2} = \frac{\dot{M}_{O2} + .21\,\dot{M}_{air}}{\dot{M}_T}$$

where $\dot{M}_T$ = Total mass flow rate of gas.

$\dot{M}_{O2}$ = Mass flow rate of oxygen supply.

$\dot{M}_{air}$ = Mass flow rate of air supply.

$\dot{M}_T = \dot{M}_{O2} + \dot{M}_{air}$
0
therefore $$\dot{M}_{O2} = \dot{M}_T\left(\frac{F_{IO2} - .21}{0.79}\right)$$

and

-continued $$\dot{M}_{air} = \dot{M}_T\left(\frac{1 - F_{IO2}}{0.79}\right)$$

It will be observed from the above listed oxygen concentration schedule that $F_{IO2}$ is 0.21 for altitudes less than 14,000 feet, and $F_{IO2}$ is 1.0 for altitudes equal to or greater than 28,000 feet. Thus, $\dot{M}_{O2}$ will be zero below 14,000 feet and $\dot{M}_{air}$ will be zero at or above 28,000 feet.

The mass flow of each gas is proportional to the valve opening area and the supply pressure.

$\dot{M}_{air} = kA_{11}P_{01}$
$\dot{M}_{O2} = kA_{12}P_{02}$ where $P_{01}$=Pressure of air supply.
$P_{02}$=Pressure of oxygen supply.
$A_{11}$=Area of air valve opening.
$A_{12}$=Area of oxygen valve opening.
k=Conversion factor for converting valve area to displacement and equal to $\pi$ times the diameter of the valve opening.

The factor k is inserted so that the resultant valve command will be the desired displacement for each valve. The valve commands are converted by servoamplifier means (not shown) into electrical signals to move valve actuators 86, 88 until the desired position (displacement) is achieved as sensed by position transducers 82, 85.

The corresponding area of the openings of oxygen valve 60 and air valve 62 for a particular valve displacement command will be as follows.

$$A_{11} = \dot{M}_T\left(\frac{1 - F_{IO2}}{0.79\,kP_{01}}\right)$$

$$A_{12} = \dot{M}_T\left(\frac{F_{IO2} - .21}{0.79\,kP_{01}}\right)$$

Referring again to the oxygen concentration schedule, for altitudes below 14,000 feet, the oxygen valve area $A_{12}$ is zero, and only air is supplied to the pilot's mask. At or above altitudes of 28,000 feet, the air valve area $A_{11}$ is zero and only oxygen is supplied to the pilot's mask. Between 14,000 and 28,000 feet, both oxygen and air are supplied as a function of valve area ratio.

As seen in FIG. 1, the oxygen supply pressure at oxygen supply 74 and air supply pressure t air supply 76 are sensed by pressure transducers 78 and 80 and are compensated for by dividing the respective valve commands by the measured values.

The functions and operations of controller 50 are readily adaptable to microprocessor implementation. Analog-to-digital conversion of input pressure signals to controller 50, and digital-to-analog conversion of the output valve commands may be accomplished as is well known in the art.

Figure 2:
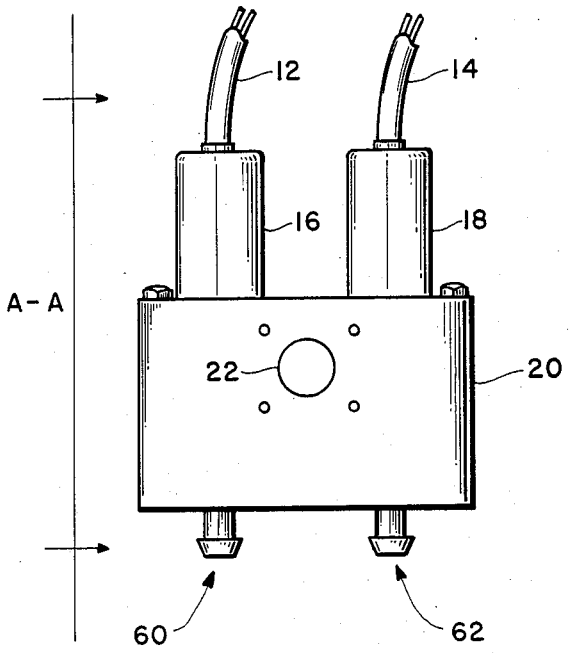
FIG. 2 is a side view showing two valves in a valve housing.

FIG. 2 shows the preferred valve assembly for the invention with oxygen valve 60 and air valve 62 mounted side by side in housing 20. The housing serves as a manifold to deliver a breathable gas mixture to the pilot's mask 64. Oxygen and air from oxygen supply 74 and air supply 76 are admitted through nozzles at to bottom into an interior space 44 (see FIG. 3) of housing 20 where they are mixed for delivery through orifice 22 to the pilot's mask 64. Mounted on housing 20 are two linear variable differential transducers 16 and 18 (having electrical leads 12, 14) which measure valve displacement and perform the function of the position transducers 82, 84 in FIG. 1.

Figure 3:
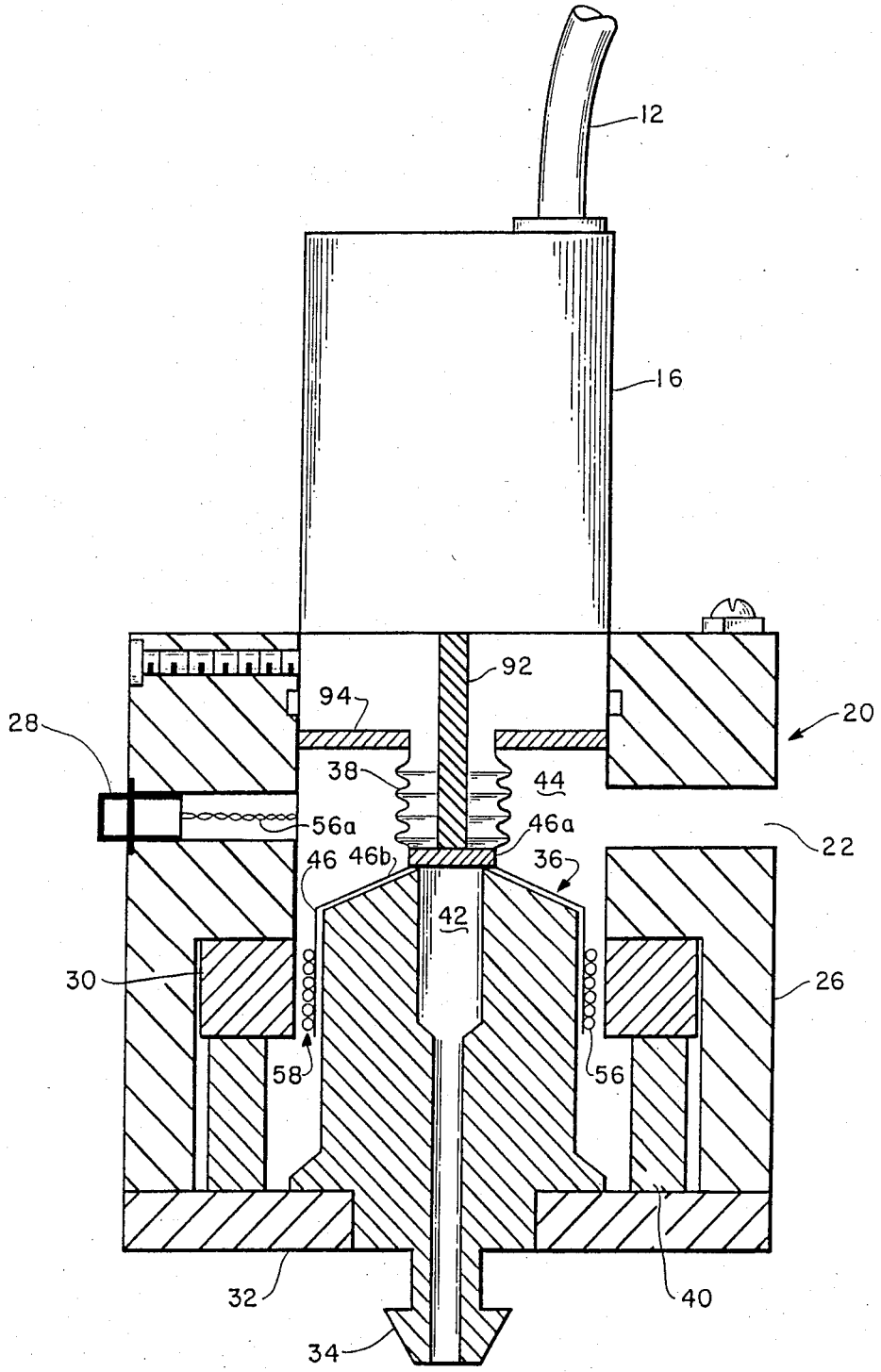
FIG. 3 is a cross sectional end view of the valve structure of a preferred embodiment taken along line A—A of FIG. 2.

Referring to FIG. 3, housing 20 comprises a housing block 26 having an opening at the top for linear variable differential transducer 16. (Only oxygen valve 60 is shown in FIG. 3. However, the structure and operation of air valve 62 is identical and therefore the following description applies to air valve 62 as well.) The inlet nozzle (indicated at 34) is hollow and is mounted in a base piece 32 attached to the bottom of the housing block 26. The upper surface of nozzle 34 has an opening 42 covered by a voice coil assembly 36. The voice coil assembly 36 includes a bobbin 46 having a solid center portion 46*a* adapted to fit over the top surface of nozzle 34 in sealing relationship with opening 42, and a surrounding portion 46*b*. A voice coil 56 is wrapped around surrounding portion 46*b* of bobbin 46 adjacent annular outer pole piece 30 and is positioned within an air gap 58 formed by pole piece 30 and nozzle 34. A permanent magnet 40 is positioned between outer pole piece 30 and base piece 32. Pole piece 30, base piece 32 and nozzle 34 are made of magnetic material and together with permanent magnet 40 form the magnetic circuit for creating a magnetic flux in air gap 58. A header 28 provides electrical connection for the lead wires 56*a* to voice coil 56. A single permanent magnet 40 may be used to provide magnetic flux for both valves.

When current is applied to voice coil 56, a force is generated causing bobbin 46 to axially move toward or away from the nozzle 34. This movement of bobbin 46 is caused by the reaction when current is applied to voice coil 56 within the magnetic flux generated in the air gap 58 between the outer pole piece 30 and the nozzle 34, which acts as the center pole. Movement of bobbin 46 away from nozzle 34 separates the solid center portion 46*a* from sealing relationship with opening 42, and opens a path for oxygen in nozzle 34 to flow around the periphery of surrounding portion 46*b* of bobbin 46 through air gap 58 and into the interior space 44 of housing 20.

A balance bellows 38 positioned between bobbin 46 and an annular flange 94 in housing block 26 maintains the bobbin in a normally closed (sealed) position with respect to the opening 42 in nozzle 34. The bellows 38 also serves to definethe interior space 44 where oxygen entering through nozzle 34 combine with air entering through air valve 62 before exiting through orifice 22.

Attached to the solid center portion 46*a* of bobbin 46 and inside balance bellows 38 is sensing arm 92 of the linear variable differential transducer 16. Axial movement of bobbin 46 toward or away from nozzle 34, which movement varies the opening of the oxygen valve 60, is detected by the transducer 16 through arm 92 and is translated into an electrical signal indicative of the valve opening displacement. This signal is used as the feedback signal in the position transducer 84 of FIG. 1 to determine when proper valve command position is reached.

Although the present invention has been described with reference to the particular embodiment herein set forth, it is understood that the present disclosure has been made only by way of example and that numerous changes in the details of the equipment or method described may be resorted to without departing from the spirit and scope of the invention. Thus, the scope of the invention should not be limited by the foregoing specification but only by the scope of the claims appended hereto.

What is claimed is:

1. A valve assembly for providing a breathable gas mixture, comprising:

a housing;

a first nozzle mounted in said housing, said first nozzle having an opening therein in communication with a first gas;

a second nozzle mounted in said housing, said second nozzle having an opening therein in communication with a second gas;

a bobbin surrounding each of said first and second nozzle adjacent said openings therein, each bobbin having a voice coil wound therearound, said bobbin having a portion adapted to close said openings to the passage of said gas therethrough; and means including said first and second nozzles for forming an air gap for the passage of magnetic flux through each voice coil to cause movement of said bobbins with respect to said nozzles in response to a current applied to said voice coil; and mixing means in said housing for receiving said first and second gases supplied through said first and second nozzles in response to movement of said bobbins.

2. The valve assembly as described in claim 1, wherein said means for forming said air gap include outer pole pieces surrounding said first and second nozzles and connected to a permanent magnet.

3. The valve assembly as described in claim 2, wherein said first and second nozzles are made of magnetic material.

4. The valve assembly of claim 1, further including means connected to each bobbin for detecting displacement of the bobbins with respect to said first and second nozzles.

5. The valve assembly of claim 4, wherein said means for detecting displacement comprises linear variable differential transducers.

6. The valve assembly of claim 1, wherein said mixing means comprises a manifold formed in said housing and having a single outlet orifice.

* * * * *